US010830160B2

(12) United States Patent
Bigot et al.

(10) Patent No.: US 10,830,160 B2
(45) Date of Patent: Nov. 10, 2020

(54) DEVICE FOR CONTROLLING THE COMPRESSION RATE OF A VARIABLE COMPRESSION RATIO ENGINE, COMPRISING A TWO-WAY SOLENOID VALVE PROVIDED WITH A SECONDARY CIRCUIT FOR FLUID REFILLING

(71) Applicants: Vianney Rabhi, Lyons (FR); MCE 5 Development, Lyons (FR)

(72) Inventors: Sylvain Bigot, Pau (FR); Benjamin Teyssier, Serezin du Rhone (FR); François Besson, Meyzieu (FR)

(73) Assignee: MCE 5 Development, Lyons (FR)

( * ) Notice: Subject to any disclaimer, the term of this patent is extended or adjusted under 35 U.S.C. 154(b) by 0 days.

(21) Appl. No.: 16/490,489

(22) PCT Filed: Feb. 28, 2018

(86) PCT No.: PCT/FR2018/050469
§ 371 (c)(1),
(2) Date: Aug. 30, 2019

(87) PCT Pub. No.: WO2018/158539
PCT Pub. Date: Sep. 7, 2018

(65) Prior Publication Data

US 2020/0011254 A1 Jan. 9, 2020

(30) Foreign Application Priority Data

Mar. 1, 2017 (FR) ..... 17 51686

(51) Int. Cl.
*F02D 15/00* (2006.01)
*F15B 1/02* (2006.01)

(52) U.S. Cl.
CPC ..... *F02D 15/00* (2013.01); *F15B 1/02* (2013.01); *F02D 2700/035* (2013.01); *F15B 2201/411* (2013.01)

(58) Field of Classification Search
CPC ..... F02D 15/00; F02D 2700/035; F15B 1/02
See application file for complete search history.

(56) References Cited

U.S. PATENT DOCUMENTS 5,279,525 A * 1/1994 Rattunde ..... F16H 61/66272 474/28
6,026,860 A * 2/2000 Teichmann ..... F16K 31/06 137/870

(Continued)

FOREIGN PATENT DOCUMENTS

DE 1102513 B 3/1961
DE 102005043726 B4 5/2014

(Continued)

OTHER PUBLICATIONS

International Search Report for International Application No. PCT/FR2018/050469 dated Jun. 6, 2018, 3 pages.

(Continued)

*Primary Examiner* — Kevin A Lathers
(74) *Attorney, Agent, or Firm* — TraskBritt

(57) ABSTRACT

A device for controlling the compression rate of a variable compression ratio engine comprises: an actuating cylinder comprising a piston defining two chambers for receiving a pressure fluid, a pressure accumulator supplying the pressure fluid, a first fluid circuit connecting the upper chamber to the accumulator and comprising a first valve assembly for controlling the flow of the fluid in the first fluid circuit, and a second fluid circuit connecting the lower chamber to the accumulator and comprising a second valve assembly for controlling the flow of a fluid in the second fluid circuit. At least one of the fluid circuits comprises a bypass conduit (Continued)

arranged so as to connect one of the chambers to the accumulator. The bypass conduit comprises a non-return valve.

17 Claims, 5 Drawing Sheets

(56) References Cited

U.S. PATENT DOCUMENTS

| | | | | |
|---|---|---|---|---|
| 8,439,004 | B2 * | 5/2013 | Rabhi | F02B 75/048 123/48 B |
| 2012/0174895 | A1 * | 7/2012 | Rabhi | F16K 31/0655 123/48 B |

FOREIGN PATENT DOCUMENTS

| | | | |
|---|---|---|---|
| EP | 0893635 | B1 | 4/2003 |
| WO | 2008/148948 | A2 | 12/2008 |
| WO | 2016/097546 | A1 | 6/2016 |

OTHER PUBLICATIONS

International Written Opinion for International Application No. PCT/FR2018/050469 dated Jun. 6, 2018, 5 pages.

* cited by examiner

DEVICE FOR CONTROLLING THE COMPRESSION RATE OF A VARIABLE COMPRESSION RATIO ENGINE, COMPRISING A TWO-WAY SOLENOID VALVE PROVIDED WITH A SECONDARY CIRCUIT FOR FLUID REFILLING

CROSS-REFERENCE TO RELATED APPLICATIONS

This application is a national phase entry under 35 U.S.C. § 371 of International Patent Application PCT/FR2018/050469, filed Feb. 28, 2018, designating the United States of America and published as International Patent Publication WO 2018/158539 A1 on Sep. 7, 2018, which claims the benefit under Article 8 of the Patent Cooperation Treaty to French Patent Application Serial No. 1751686, filed Mar. 1, 2017.

TECHNICAL FIELD

The present disclosure relates to a device for controlling the compression ratio of a variable compression ratio engine, comprising an actuating cylinder comprising a piston defining two chambers for receiving a pressurized fluid, an accumulator delivering a pressurized fluid to the two chambers via two distinct fluid circuits each, each fluid circuit comprising a solenoid valve assembly.

The present disclosure also relates to an engine with a variable compression ratio comprising such a device and a solenoid valve for operating such a device.

BACKGROUND

A variable compression ratio engine with a hydraulic actuating cylinder controlled by a single-coil solenoid valve for synchronous control of the opening and closing of the upper and lower chambers of the actuating cylinder is known from application WO2016/097546. To do this, the solenoid valve 1 comprises two valve assemblies 2A, 2B, each controlling the flow of a fluid, each valve assembly 2A, 2B having a valve body comprising a longitudinal channel 30A, 30B with an axis AA communicating with at least two fluid conduits 31A, 32A, 31B, 32B and a valve arrangement comprising a piston 4A, 4B movably mounted within the channel 30A, 30B between an opening position of the fluid conduits 31A, 32A, 31B, 32B, to allow the fluid to pass from one fluid conduit to another and a closed position of the fluid conduits 31A, 32A, 31B, 32B relative to each other, the piston 4A, 4B comprising a magnetizable end portion 40A, 40B and an end, opposite the magnetizable end portion, forming a flap adapted to bear against a seat of the valve body. The solenoid valve also includes a single electromagnetic actuator 5 interposed between the two valve assemblies, and capable of simultaneously controlling the movement of the piston 4A, 4B of each valve assembly in the opening position of the fluid conduits 31A, 32A, 31B, 32B. When using a compression ratio control device (FIG. 1), the fluid conduit 31A is connected to the upper chamber 113 of the actuating cylinder while the fluid conduit 31B is connected to the lower chamber 112 of the actuating cylinder. The channel 30A is connected to a pressure accumulator 33 to supply the upper and lower chambers with pressurized fluid, while the channel 30B is closed at the end. In order to ensure the passage of fluid from the lower chamber 112 to the upper chamber 113 of the actuating cylinder and vice versa, the fluid conduits 32A, 32B are connected to each other by a common channel 34. The solenoid valve 1 is thus a two-way solenoid valve ensuring the opening or closing of the fluid circuit of the two valve assemblies 2A, 2B through the simultaneous displacement of the two pistons 4A, 4B pursuant to the magnetic field by the actuator 5. The fluid path when the solenoid valve is open is shown in FIG. 1.

In order to ensure the proper functioning of the compression ratio control system, it is necessary for the cylinder to be watertight. However, micro-leaks may occur at the valve seat, particularly in the upper chamber due to the high pressure exerted on the valve of the upper chamber (during combustion peaks, the upper chamber that takes up combustion forces, may be subjected to high pressures—in the order of 270 bar) or due to impurities that have been concentrated at the valve seat. The operation of the compression ratio control system, and therefore that of the engine, is then altered: when one of the chambers has a micro-leak, there is a decrease in the average pressure in each chamber. When this average pressure falls below a certain value, particularly below 20 bar, the amplitude of the oscillations of the actuating cylinder during a cycle increases, thereby compromising the operation of the engine.

FIG. 2 shows the pressure curves over several engine cycles (720° crankshaft) when the control device has a micro-leak. It is understood from the operation of the control system that a leak occurs first during pressure peaks in the upper chamber due to the high value of the instantaneous pressure reached. In addition, since the time duration of pressure peaks is very short (from 1 to 5×10"4 s depending on the engine speed), the volume of fluid evacuated is very small in the event of a micro-leak. The curve shows the effect of such a micro-leakage: a small volume of oil is discharged from the system at each cycle and leads to a decrease in the average pressure in the chambers; the crossing of the curves occurs substantially at the level of the substantially horizontal curve and corresponding to the fluid pressure of the accumulator at the beginning, and gradually drifts to be half the initial value at the end of the cycles represented, whereas when there is no leak, the crossing of the curves is maintained throughout the cycles at the level of the accumulator fluid pressure curve (FIG. 3). When the operation continues, a stage is reached where the oil no longer fills the upper and lower chambers. The piston of the actuating cylinder is then free to move freely in the "vacuum cushion" created by the alternating forces. The compression ratio maintaining function is then no longer provided.

The present disclosure aims to remedy these problems by proposing a compression ratio control system for an engine with a variable compression ratio allowing the compression ratio to be maintained even in the event of micro-leaks in one of the chambers.

BRIEF SUMMARY

For this purpose, and according to a first aspect, the present disclosure proposes a device to control the compression ratio of an engine with a variable compression ratio, comprising an actuating cylinder comprising a piston defining two chambers intended to receive a pressurized fluid, a pressure accumulator delivering the pressurized fluid, a first fluid circuit connecting the upper chamber to the accumulator and comprising a first valve assembly capable of controlling the flow of the fluid in the first fluid circuit, a second fluid circuit connecting the lower chamber to the accumulator and comprising a second valve assembly adapted to control the flow of a fluid in the second fluid circuit, characterized in that at least one of the fluid circuits comprises a bypass conduit arranged to connect one of the chambers to the accumulator, the bypass conduit comprising a non-return valve arranged to block the flow of the fluid from the chamber to the accumulator.

The presence of a bypass circuit (or secondary circuit) including a non-return valve thus arranged makes it possible to compensate for the pressure drop of the chambers below the accumulator pressure in the event of the presence of micro-leaks in one of the chambers by allowing the refilling of the chamber concerned by the pressure drop. The bypass circuit thus makes it possible to guarantee an average pressure in the chambers at least equal to the pressure of the accumulator, thus making it possible to obtain oscillations of the actuating cylinder during a cycle within acceptable values (around 3 mm).

Advantageously, the bypass conduit is arranged to make a circuit parallel to the fluid circuit of the chamber that the bypass conduit is connected to. In particular, the non-return valve is connected in parallel with the fluid circuit.

Advantageously, the bypass conduit is arranged to connect the lower chamber to the accumulator.

Advantageously, each fluid circuit has a bypass circuit with a non-return valve.

Advantageously, the first valve assembly and the second valve assembly are connected to the accumulator via a common conduit.

Advantageously, the first and second fluid circuits and the first and second valve assemblies are arranged with a magnetic actuator to form a solenoid valve allowing simultaneous opening and closing of the upper and lower chambers that the solenoid valve is connected to.

According to another aspect, the present disclosure relates to a solenoid valve comprising two valve assemblies for controlling the flow of a fluid delivered under pressure by a pressure accumulator, each valve assembly having a valve body comprising a longitudinal channel of axis AA communicating with at least two fluid circuits and a valve arrangement comprising a piston mounted movably within the channel between an opening position of the fluid circuits to allow the passage of fluid from one fluid circuit to another and a closing position of the fluid circuits relative to each other, the piston comprising a magnetizable end portion and an end, opposite the magnetizable end portion, forming a valve capable of bearing against a seat to cause the closing position, and a single electromagnetic actuator capable of simultaneously controlling the movement of the piston of each valve assembly into the opening position of the fluid circuits, the actuator, interposed between the two valve assemblies, comprising an electromagnetic coil having a coil bore housing a stationary magnetizable target extending opposite the magnetizable end portions of the pistons of each valve assembly, characterized in that at least one of the fluid circuits of the solenoid valve comprises a bypass conduit provided with a non-return valve arranged to block the flow of fluid toward the accumulator.

According to other advantageous and non-limiting characteristics of the present disclosure, taken either separately or in any technically feasible combination:

- the non-return valve is connected in parallel with the fluid circuit that it is connected to,
- the non-return valve is connected in parallel with the part of the fluid circuit connecting the channel to the accumulator,
- each fluid circuit has a bypass circuit with a non-return valve.

And when the solenoid valve is associated with an actuating cylinder comprising two chambers (a lower chamber and an upper chamber) delimited by a piston:

- the bypass conduit is arranged to make a circuit parallel to the fluid circuit of the chamber that the bypass conduit is connected to.
- the bypass conduit is arranged to connect the lower chamber of the actuating cylinder to the accumulator; the first and second fluid circuits and the first and second valve assemblies are arranged with a magnetic actuator to form a solenoid valve allowing simultaneous opening and closing of the upper and lower chambers that the solenoid valve is connected to.

The present disclosure also relates to a variable compression ratio engine including a device to control the compression ratio as described above.

Due to the presence of a bypass circuit, the presence of micro-leaks without risk of altering the operation of the compression ratio control device makes it possible to tolerate the presence of a micro-leak in one of the chambers. Tolerating the presence of a micro-leak has many advantages. First, it reduces the accuracy of the parts to be machined and therefore reduces manufacturing costs. This then increases wear tolerance. Finally, this reduces cavitation in the lower chamber, when the micro-leakage occurs in the upper chamber.

BRIEF DESCRIPTION OF THE DRAWINGS

Other purposes and advantages of the present disclosure will be apparent from the following description, made with reference to the accompanying drawings, wherein.

For greater clarity, the same or similar elements of the different embodiments are marked by identical references on all the figures.

DETAILED DESCRIPTION

Figure 1:
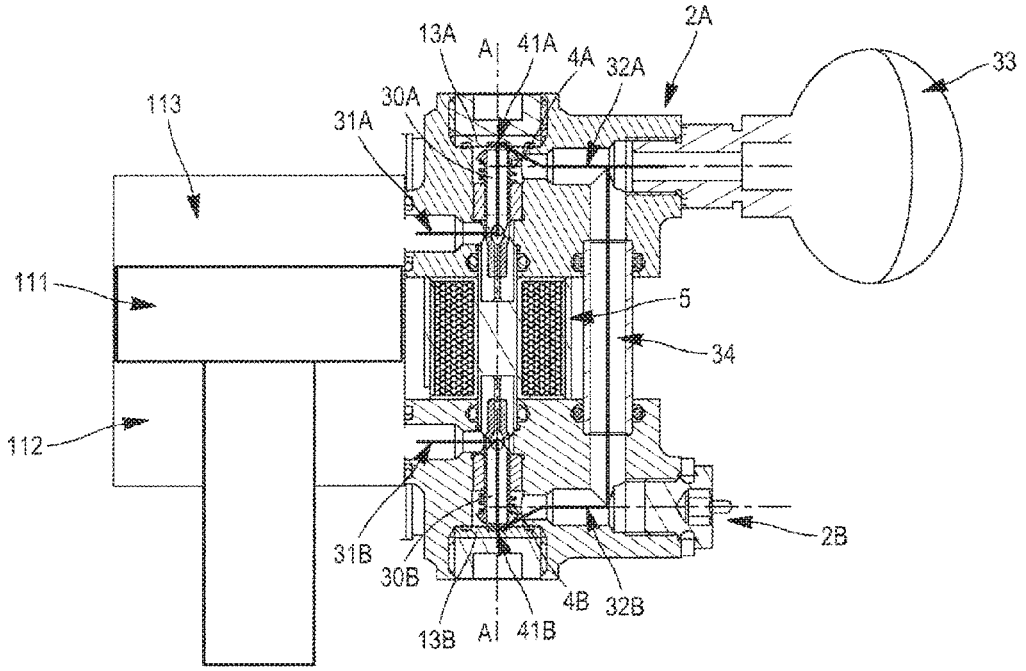
FIG. 1 (PRIOR ART)
FIG. 1 represents a schematic view of a device for controlling the compression ratio of the prior art used to control the compression ratio of an engine with a variable compression ratio.
Figure 2:
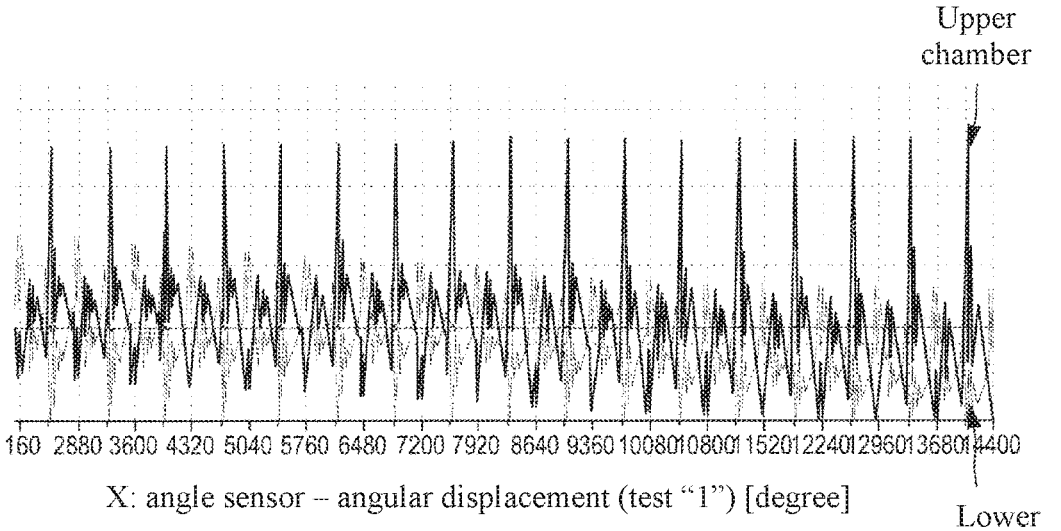
FIG. 2 (PRIOR ART)
FIG. 2 shows the pressure curve over several engine cycles (720° crankshaft) when the control system in FIG. 1 has a micro-leak.
Figure 3:
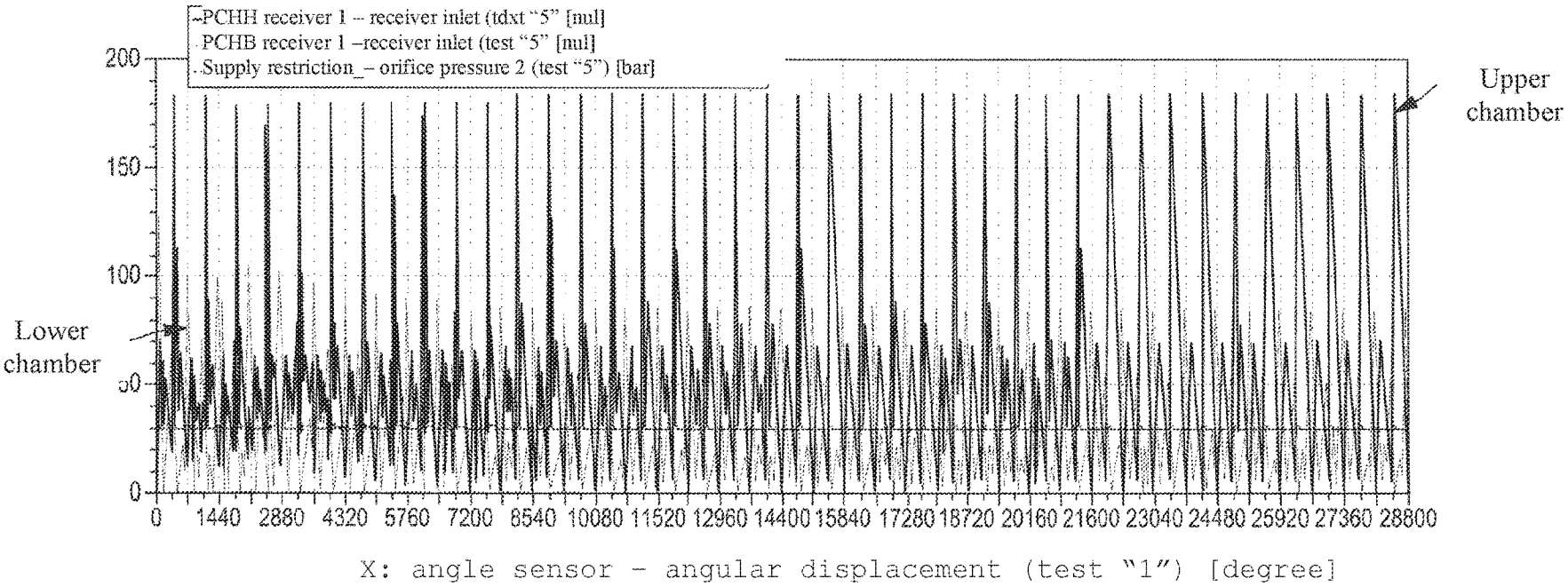
FIG. 3 (PRIOR ART)
FIG. 3 shows the pressure curves over several engine cycles (720° crankshaft) when the control system in FIG. 1 does not have a micro-leak.
Figure 4:
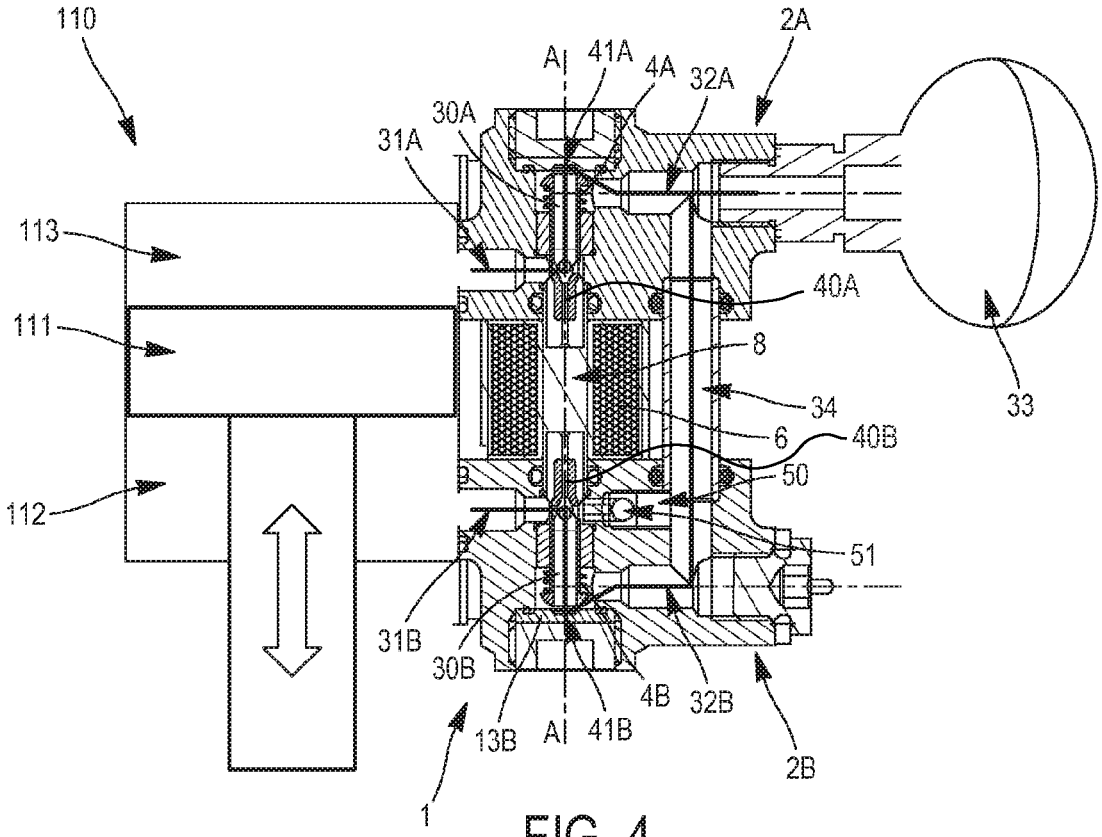
FIG. 4 represents a schematic view of a compression ratio control device according to the present disclosure to be used to control the compression ratio of a variable compression ratio engine, when the compression ratio control device is in the open position.
Figure 5:
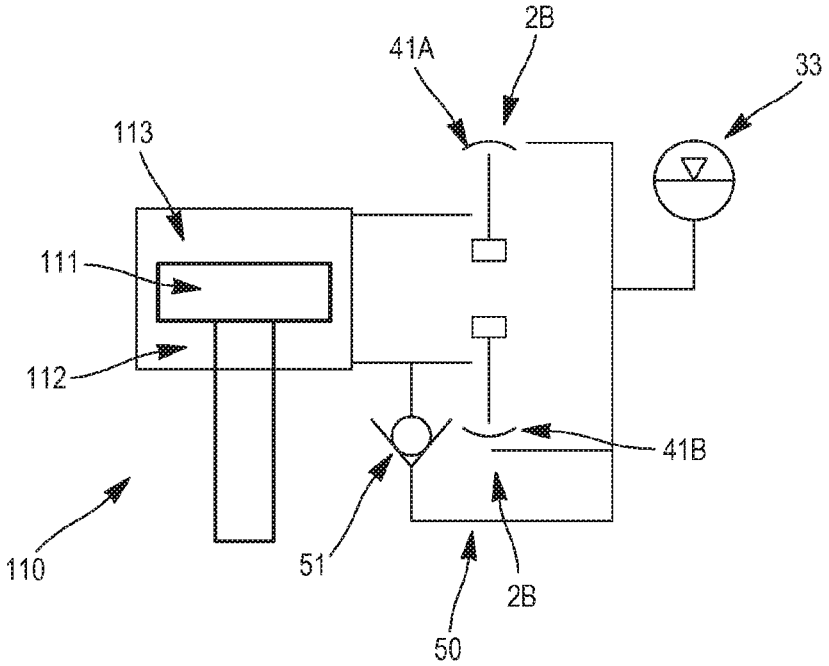
FIG. 5 is a schematized view of the control device of FIG. 4.

In connection with FIGS. 4 to 8, a compression ratio control device is described for use in controlling the compression ratio of a variable compression ratio engine of the type described in the application WO2008/148948, for example.

The compression ratio control device comprises an actuating cylinder 110 comprising a piston 111 defining two chambers, an upper chamber 113 and a lower chamber 112, intended to be supplied with hydraulic fluid under pressure, in this case oil, from a pressure accumulator 33. To do this, a first fluid circuit 31A, 32A connecting the upper chamber to the accumulator and comprising a first valve assembly 4A, a second fluid circuit 31B, 32B connecting the lower chamber to the accumulator and comprising a second valve assembly 4B.

In the example shown, the two fluid circuits and the two valve assemblies are arranged with a magnetic actuator 5 to form a solenoid valve 1 of the type described in the application WO2016/097546, allowing the upper and lower chambers to be opened and closed simultaneously.

The solenoid valve 1 will not be described in greater details below. However, it includes all the characteristics of the solenoid valve described in the above-mentioned application. In general, however, the solenoid valve 1 consists of two valve assemblies 2A, 2B for controlling the flow of a fluid and a single electromagnetic actuator 5 interposed between the two valve assemblies.

Each valve assembly 2A, 2B has a valve body comprising a longitudinal channel 30A, 30B with an axis AA communicating with at least two fluid conduits 31A, 32A, 31B, 32B. The channels 30A, 30B are opening on the actuator 5 side and closed on the side opposite the actuator. The fluid conduits 31A, 32A, 31B, 32B are located on the side walls of the channels 30A, 30B. The fluid conduit 31A of the solenoid valve 1 is connected to the upper chamber 113 of the actuating cylinder, while the fluid conduit 31B is connected to the lower chamber 112 of the actuating cylinder. The channel 30A is connected to the pressure accumulator 33, while the channel 30B is closed at the end. In order to ensure the passage of fluid from the lower chamber 112 to the upper chamber 113 of the actuating cylinder and vice versa, the fluid conduits 32A, 32B are connected to each other by a common channel 34.

Each valve assembly also includes a valve arrangement. The valve arrangement comprises a piston 4A, 4B having a tubular body mounted so as to be movable within the channel 30A, 30B between an opening position of the fluid conduits 31A, 32A, 31B, 32B to allow the passage of the fluid from one fluid conduit to another and a closing position of the fluid conduits 31A, 32A, 31B, 32B with respect to each other. More specifically, each piston 4A, 4B has an end 41A, 41B capable of bearing against a seat 13A, 13B at the end of the channel 30A, 30B associated furthest from the actuator 5 (i.e., at the closed end of the channel), and thus closing the fluid conduits. The end 41A, 41B thus forms a flap. An opening and orifices are provided respectively at the end 41A, 41B and the tubular body of the pistons 4A, 4B to allow the fluid to pass through them. The fluid conduits 31A, 31B are so arranged as to open in the channels 30A, 30B opposite the wall portion of the piston provided with orifices while the fluid conduits 32A, 32B are so arranged as to open in the channels 30A, 30B near the closed end of the corresponding channel.

The electromagnetic actuator 5 comprises a cylindrical electromagnetic coil 6 having a coil bore and a part constituting a magnetizable target 8, advantageously made of a magnetizable ferrous alloy, such as an iron/cobalt alloy, an iron/silicon alloy or others, fixedly mounted in the bore. When each piston moves under the control of the electromagnetic actuator from the closed position of the fluid conduits to the open position of the fluid conduits, each piston 4A, 4B moves in the corresponding channel toward the target part to stop against the corresponding end face of the target part 8.

The solenoid valve 1 thus constitutes a two-way solenoid valve ensuring the opening or closing of the fluid circuit of the two-valve assemblies 2A, 2B through the simultaneous displacement of the two pistons 4A, 4B pursuant to the magnetic field created in the coil 6. The fluid path is similar to that of a valveless control device as shown in FIG. 1. The engine compression ratio is controlled by controlling the flow of pressurized fluid from one chamber to the other of the actuating cylinder 110, and vice versa, by means of the solenoid valve 1.

The control device also includes a so-called bypass conduit 50 comprising a non-return valve 51 allowing the refilling of one of the chambers in the event of micro-leaks generating micro-leaks of fluid from one of the chambers.

In the embodiment shown, the bypass conduit 50 is arranged to connect the fluid conduit leading to the lower chamber to the fluid conduit leading to the accumulator. It thus constitutes a bypass conduit 50 of the second fluid circuit (or lower fluid circuit). The bypass conduit 50 is arranged to make a circuit parallel to the fluid circuit of the chamber to which the bypass conduit 50 is connected.

Figure 6:
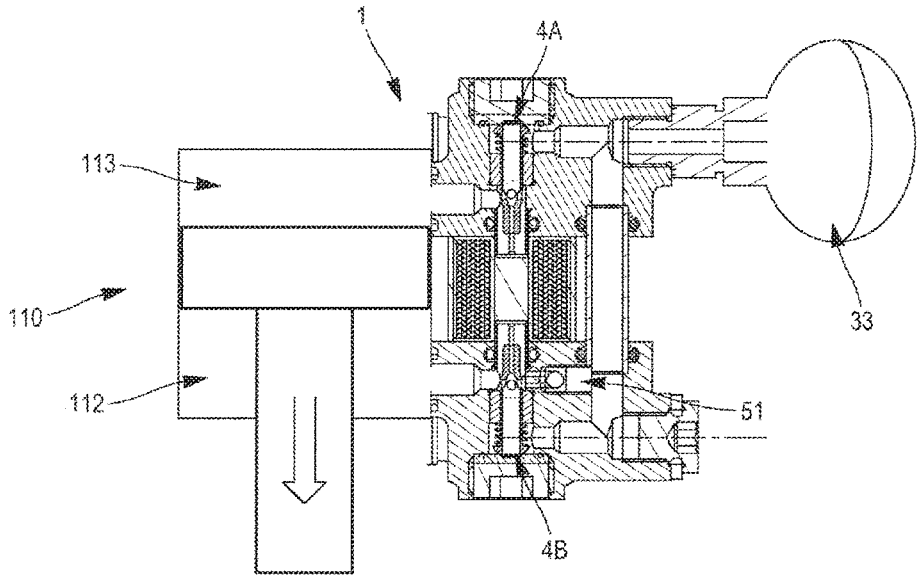
FIGS. 6 and 7 represent the compression ratio control device in FIG. 4 in the closed position, with the non-return valve in the closed and open position respectively.
Figure 7:
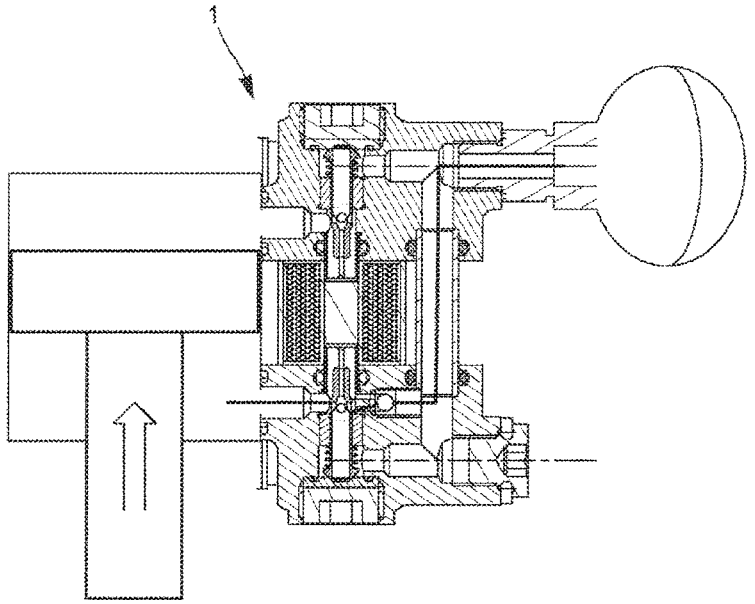

FIGS. 6 and 7 show the solenoid valve in the closed position. In the normal case, i.e., in the absence of micro-leaks at the cylinder and therefore of micro-leaks, the pressure of the lower chamber of the cylinder is higher than the pressure of the accumulator. In this case, the non-return valve 51, arranged in parallel with the controlled valve 41B, remains closed (FIG. 6). When the solenoid valve is closed and the upper chamber has a micro-leak, the first pressure peak in the chamber after closing causes the pressure in the lower chamber to drop (at the time of closing, the pressure situation is the same as the situation before closing). When the pressure drops below the accumulator pressure, the non-return valve 51, in parallel with the controlled valve 41B, opens, allowing an additional volume of fluid to be introduced into the lower chamber of the cylinder and thus increasing the pressure in the actuating cylinder. In a few cycles, it can be observed that the average pressure in the cylinder increases. If the cylinder does not leak, except for a micro-leak, and the non-return valve 51 has sufficient reactivity, a minimum pressure in the chamber below the supply pressure can be achieved. This ensures a minimum pressure in the actuating cylinder despite a small leak in the upper chamber. In addition, it tends to improve the stability of the compression ratio control system by increasing the average pressure in the actuating cylinder.

Figure 8:
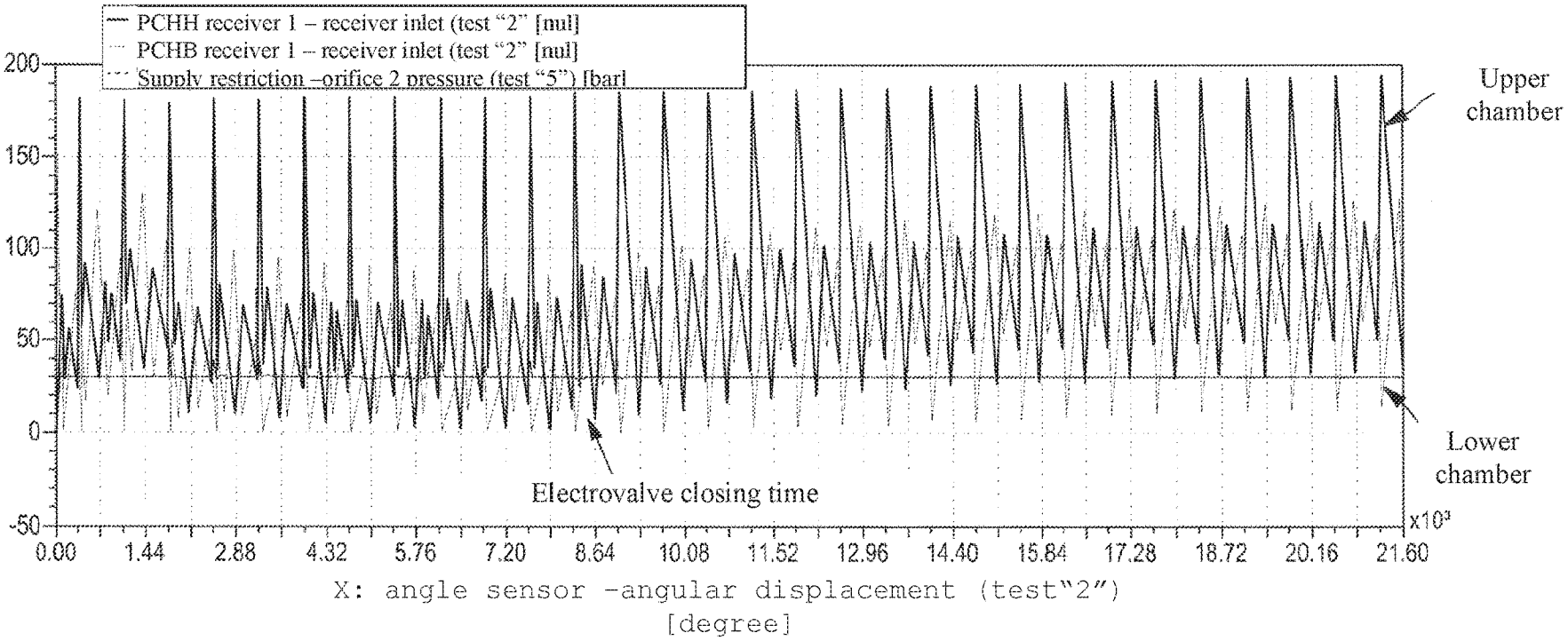
FIG. 8 shows the pressure curves over an engine cycle (720° crankshaft) when the two-way solenoid valve has a secondary fluid refilling circuit with a non-return valve.

FIG. 8 shows the pressure curves over an engine cycle (720° crankshaft) when the two-way solenoid valve has a secondary fluid refilling circuit with a non-return valve 51. It can then be seen that with the presence of bypass conduit 50, the pressure in the chambers is increased.

In the example shown, the bypass conduit 50 is intended to refill the lower chamber 112. This is a preferred embodiment. It is of course obvious that the present disclosure is not limited to this arrangement, and that a compression ratio control device with a bypass conduit 50 designed to refill the upper chamber 113 can be provided. Thus, the bypass conduit 50 including the non-return valve 51 is arranged to connect the fluid conduit leading to the upper chamber to the fluid conduit leading to the accumulator. It thus constitutes a bypass conduit 50 of the first fluid circuit (or upper fluid circuit).

Similarly, without going beyond the scope of the present disclosure, a compression ratio control device may be provided comprising a combined arrangement of the two bypass conduits 50 previously described so as to allow the refilling of either of the chambers.

The present disclosure is described above as an example. It is understood that those skilled in the art are capable of creating different alternative embodiments of the present disclosure without departing from the scope of the present disclosure.

The invention claimed is:

1. A device for controlling a compression ratio of a variable compression ratio engine, comprising:

an actuating cylinder comprising a piston defining two chambers for receiving a pressurized fluid on opposing sides of the piston;

a pressure accumulator supplying the pressurized fluid;

a first fluid circuit connecting a first chamber of the two chambers to the accumulator and comprising a first valve assembly for controlling the flow of the fluid in the first fluid circuit;

a second fluid circuit connecting a second chamber of the two chambers to the accumulator and comprising a second valve assembly for controlling the flow of the fluid in the second fluid circuit;

wherein at least one of the first fluid circuit and the second fluid circuit has a bypass conduit connecting at least one chamber of the two chambers to the accumulator, the bypass conduit including a non-return valve configured to block flow of the fluid from the at least one chamber to the accumulator.

2. The device of claim 1, wherein the bypass conduit is arranged to make a circuit parallel to the respective fluid circuit connected to the chamber to which the bypass conduit is connected.

3. The device of claim 2, wherein the bypass conduit is configured to connect the second chamber to the accumulator.

4. The device of claim 3, wherein each of the first fluid circuit and the second fluid circuit comprises a bypass circuit comprising a non-return valve.

5. The device of claim 4, wherein the first valve assembly and the second valve assembly are connected to the accumulator by a common conduit.

6. The device of claim 5, wherein the first fluid circuit and the second fluid circuit, and the first valve assembly and the second valve assembly are arranged with a magnetic actuator to form a solenoid valve allowing the simultaneous opening and closing of the first and second chambers to which the valves are respectively connected.

7. The device of claim 1, wherein the bypass conduit is configured to connect the second chamber to the accumulator.

8. The device of claim 1, wherein each of the first fluid circuit and the second fluid circuit comprises a bypass circuit comprising a non-return valve.

9. The device of claim 1, wherein the first valve assembly and the second valve assembly are connected to the accumulator by a common conduit.

10. The device of claim 1, wherein the first fluid circuit and the second fluid circuit, and the first valve assembly and the second valve assembly are arranged with a magnetic actuator to form a solenoid valve allowing the simultaneous opening and closing of the first and second chambers to which the valves are respectively connected.

11. A solenoid valve, comprising:

two valve assemblies each for controlling the flow of a fluid supplied under pressure by a pressure accumulator, each valve assembly having a valve body comprising a longitudinal channel with an axis communicating with at least two fluid circuits; and a valve arrangement comprising a piston movably mounted within the longitudinal channel between a fluid circuit opening position to allowing the fluid to pass from one fluid circuit to another and a fluid circuit closing position relative to each other, the piston comprising a magnetizable end portion and an end, opposite the magnetizable end portion, forming a valve adapted to rest against a seat to cause the closing position, and a single electromagnetic actuator adapted to simultaneously control the displacement of the piston of each valve assembly into the opening position of the fluid circuits, the actuator, interposed between the two valve assemblies, comprising an electromagnetic coil having a coil bore housing a stationary magnetizable target extending opposite the magnetizable end portions of the pistons of each valve assembly, wherein at least one of the fluid circuits of the solenoid valve comprising a bypass conduit provided with a non-return valve arranged to block the flow of fluid toward the accumulator.

12. The solenoid valve of claim 11, wherein the non-return valve is connected in parallel with the fluid circuit to which it is connected.

13. The solenoid valve of claim 12, wherein the non-return valve is connected in parallel with the part of the fluid circuit connecting the channel to the accumulator.

14. The solenoid valve of claim 13, wherein each fluid circuit has a bypass circuit including a non-return valve.

15. The solenoid valve of claim 11, wherein the non-return valve is connected in parallel with the part of the fluid circuit connecting the channel to the accumulator.

16. The solenoid valve of claim 11, wherein each fluid circuit has a bypass circuit including a non-return valve.

17. A variable compression ratio engine comprising a device for controlling the compression ratio, the device comprising:

an actuating cylinder comprising a piston defining two chambers for receiving a pressurized fluid on opposing sides of the piston;

a pressure accumulator supplying the pressurized fluid;

a first fluid circuit connecting a first chamber of the two chambers to the accumulator and comprising a first valve assembly for controlling the flow of the fluid in the first fluid circuit;

a second fluid circuit connecting a second chamber of the two chambers to the accumulator and comprising a second valve assembly for controlling the flow of the fluid in the second fluid circuit;

wherein at least one of the first fluid circuit and the second fluid circuit has a bypass conduit connecting at least one chamber of the two chambers to the accumulator, the bypass conduit including a non-return valve configured to block flow of the fluid from the at least one chamber to the accumulator.

* * * * *